US006276258B1

(12) United States Patent
MacMillan et al.

(10) Patent No.: US 6,276,258 B1
(45) Date of Patent: Aug. 21, 2001

(54) PRESSURE ACTIVATED PISTON AND CYLINDER UNIT FOR USE IN A DIE

(75) Inventors: David R. MacMillan, Ilderton; Gary Morphy, Woodstock, both of (CA)

(73) Assignee: TI Corporate Services Limited, London (GB)

( * ) Notice: Subject to any disclaimer, the term of this patent is extended or adjusted under 35 U.S.C. 154(b) by 0 days.

(21) Appl. No.: 09/469,468

(22) Filed: Dec. 22, 1999

(51) Int. Cl.[7] ..... F01B 31/00
(52) U.S. Cl. ..... 92/164
(58) Field of Search ..... 92/161, 163, 164, 92/128

(56) References Cited

U.S. PATENT DOCUMENTS

| | | | | |
|---|---|---|---|---|
| 2,173,358 | | 9/1939 | Ernst . | |
| 2,399,550 | * | 4/1946 | Klein | 92/164 X |
| 2,758,850 | | 8/1956 | Becker . | |
| 2,798,777 | * | 7/1957 | Flick et al. | 92/161 |
| 3,027,877 | * | 4/1962 | Lansky | 92/164 X |
| 3,185,042 | | 5/1965 | Hastings . | |
| 3,188,923 | | 6/1965 | Mandelko . | |
| 3,272,132 | | 9/1966 | Stoeling et al. . | |
| 3,487,668 | | 1/1970 | Fuchs, Jr. . | |
| 3,500,759 | * | 3/1970 | Potter et al. | 92/163 X |
| 3,511,136 | * | 5/1970 | Thomas et al. | 92/161 |
| 3,608,438 | * | 9/1971 | Thomas et al. | 92/163 |
| 4,989,482 | | 2/1991 | Mason . | |
| 5,011,382 | | 4/1991 | Thompson . | |
| 5,477,774 | * | 12/1995 | Ikumi | 92/161 |

* cited by examiner

*Primary Examiner*—John E. Ryznic
(74) *Attorney, Agent, or Firm*—Ridout & Maybee

(57) ABSTRACT

A pressure activated piston and cylinder unit for use with a die block is taught which provides installation and service portions at the rear face of the unit. Also provided is a pressure activated piston and cylinder unit for use with a die block, of simplified construction.

12 Claims, 3 Drawing Sheets

PRESSURE ACTIVATED PISTON AND CYLINDER UNIT FOR USE IN A DIE

FIELD OF THE INVENTION

The invention relates to a pressure activated piston and cylinder unit for use with a die block. Such units may be used with die punch units for punching a hole or impressing the side wall of a tube while the tube is undergoing hydroforming.

BACKGROUND OF THE INVENTION

It is difficult to position a punch unit in association with a die to carry out hole punching, particularly, for example, in the punching of holes in the walls of tubes, molded vessels, extruded profile members and items of complex geometry enclosed in dies having inaccessible or difficult to access areas. Although holes in such items often may be drilled, punching is now preferred since commercially available cylinders have made for easier assembly of punch units and allow punching at a generally lower cost. In such circumstances the die may be used in conjunction with a pressurized fluid in contact with the rearward surface of the material as described in, for example, U.S. Pat. No. 3,487,668 to Fuchs, Jr. and U.S. Pat. No. 4,989,482 to Mason. In these hydroforming systems, die punches must be housed within the forming die block. As the punch is advanced to engage the forward surface of the material, the rearward surface of the workpiece is supported by the pressurized fluid. An indentation is achieved or a slug is sheared under the mechanical force applied to the material by the front edge of the punch and the force applied to the rearward surface of the workpiece by the pressurized fluid.

U.S. Pat. No. 2,173,358 to Ernst discloses a press with work ejector having a piston reciprocal therein. Ernst teaches a rather complicated system of hydraulic tubing. The piston extension port is located at the rear face of the unit, and the corresponding hydraulic piston retraction conduit extends around to the front face of the unit, then to the side of the unit. The piston retraction port is located on the front of the die punch unit, and the corresponding piston extension conduit extends around to the side of the unit. The unit is affixed by means of bolts at the front face of the unit.

U.S. Pat. No. 3,027,877 to Lansky discloses a fluid pressure motor for use in a die. Lansky's unit provides a cushioning means which will bring the piston to a smooth stop at the end of its stroke and which assists the piston in its return stroke. Lansky teaches a piston extension port and a piston retraction port on the rear face of the unit, and a restricter valve extending perpendicular to the unit. The unit is affixed by means of bolts at the front and rear faces of the unit.

U.S. Pat. No. 3,185,042 to Hastings and U.S. Pat. No. 3,188,923 to Mandelko teach pneumatic cylinders having pistons reciprocal therein. Both teach piston extension ports located at the rear face of the cylinder, and piston retraction ports located at the front face of the cylinder. Hastings teaches bolts at both the front and rear face of the cylinder, while Mandelko does not teach any apparatus for securing the cylinder to another apparatus.

None of the prior art teaches a pressure actuated piston and cylinder unit structured to facilitate and assist the housing of the unit in a forming die block. Known designs, such as those described above, are structured such that they are difficult to construct, having a multitude of parts which are subject to failure, and are difficult to install, service, and replace. Known designs also do not fit well into the often confined area of the forming die block and related machinery.

SUMMARY OF THE INVENTION

The present invention provides a pressure activated piston and cylinder unit for use in a die block. The piston and cylinder unit has a body having a rear face and having a front face for communication with the die block, a piston reciprocal in a bore within the body, a piston extension chamber in flow communication with a piston extension port, a piston retraction chamber in flow communication with a piston retraction port, and a bolt means receptacle for receiving a bolt means for affixing the unit to the die block, the bolt means receptacle extending to the rear face of the unit. The ports are located on the rear face of the unit.

The invention also provides for a cylinder unit with a one piece cylinder casing. The invention also provides a piston and cylinder unit with a rod made from hardened steel.

In one embodiment, the invention also provides a bleeder screw passageway in flow communication with the piston retraction chamber, the bleeder passageway extending to the rear face of the unit. In a preferred embodiment, the bleeder passageway communicates directly with the piston retraction chamber. In another preferred embodiment, the bleeder passageway communicates directly with the piston extension chamber.

In a preferred embodiment, the piston and cylinder unit has a plurality of the bolt means receptacles. In a further preferred embodiment, the bolt means receptacles are recessed into the rear face. In a further preferred embodiment, the die block is a hydroforming die block.

DESCRIPTION OF PREFERRED EMBODIMENTS OF THE INVENTION

The following illustrative explanations are provided to facilitate understanding of the invention. The explanations are provided as examples and are not limitative of the invention.

The piston and cylinder units of the invention may be used as die punch units for punching a hole or causing an indentation in the side wall of a workpiece, for example a tube, while it is being shaped within a die, for example, during hydroforming. The piston and cylinder unit is incorporated in the wall of the die, and generally is operated while two such dies are closed together by a press to confine the workpiece. It is also contemplated that the piston and cylinder units of the invention may be employed as ejectors or the like for breaking off and/or ejecting a part from the die, in which case normally the unit is operated while the dies are in open condition. Alternatively, the piston and cylinder units may be used for any other purpose for which die cylinders are required. The present invention is particularly useful where one requires multiple cylinders in a confined space.

Figure 1:
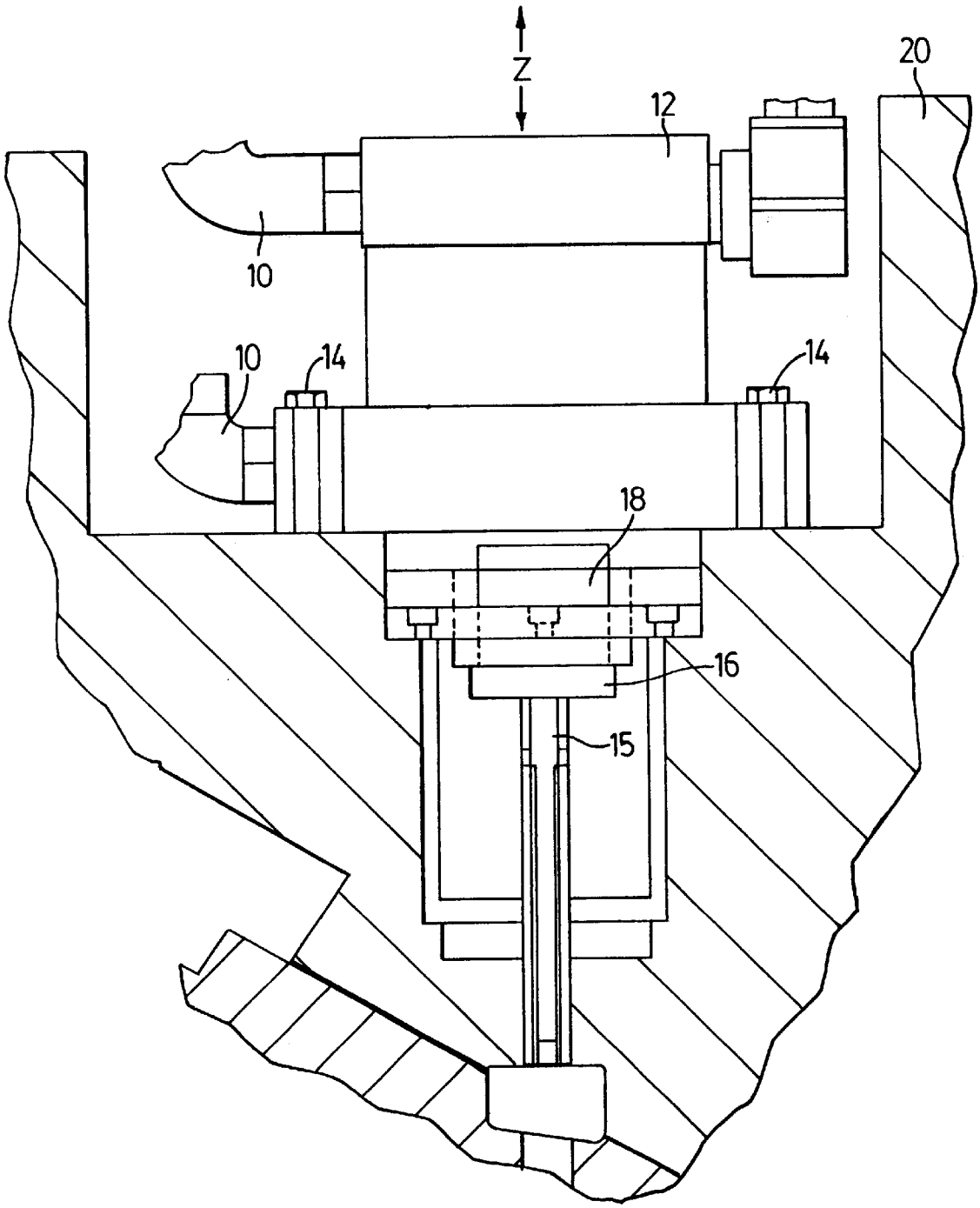
FIG. 1 (PRIOR ART)
FIG. 1 is a cross section view of a pressure activated piston and cylinder unit of the prior art.

It is periodically necessary to maintain or replace the unit or parts thereof because of wear or breakage of moving parts such as a punch. With the known arrangements, as shown in FIG. 1, the input and output conduits 10 project from the side of the piston and cylinder unit 12 perpendicular to the axis "Z" along which the piston moves reciprocally within the unit and into the die. This arrangement requires that there must be provided a wide opening or clearance around the unit in relation to the die 20 to install and operate the unit, including room for hydraulic input and output conduits 10 to project from the unit. Furthermore, clearance is needed to access bolts 14 which secure the unit to the die 20.

Figure 2:
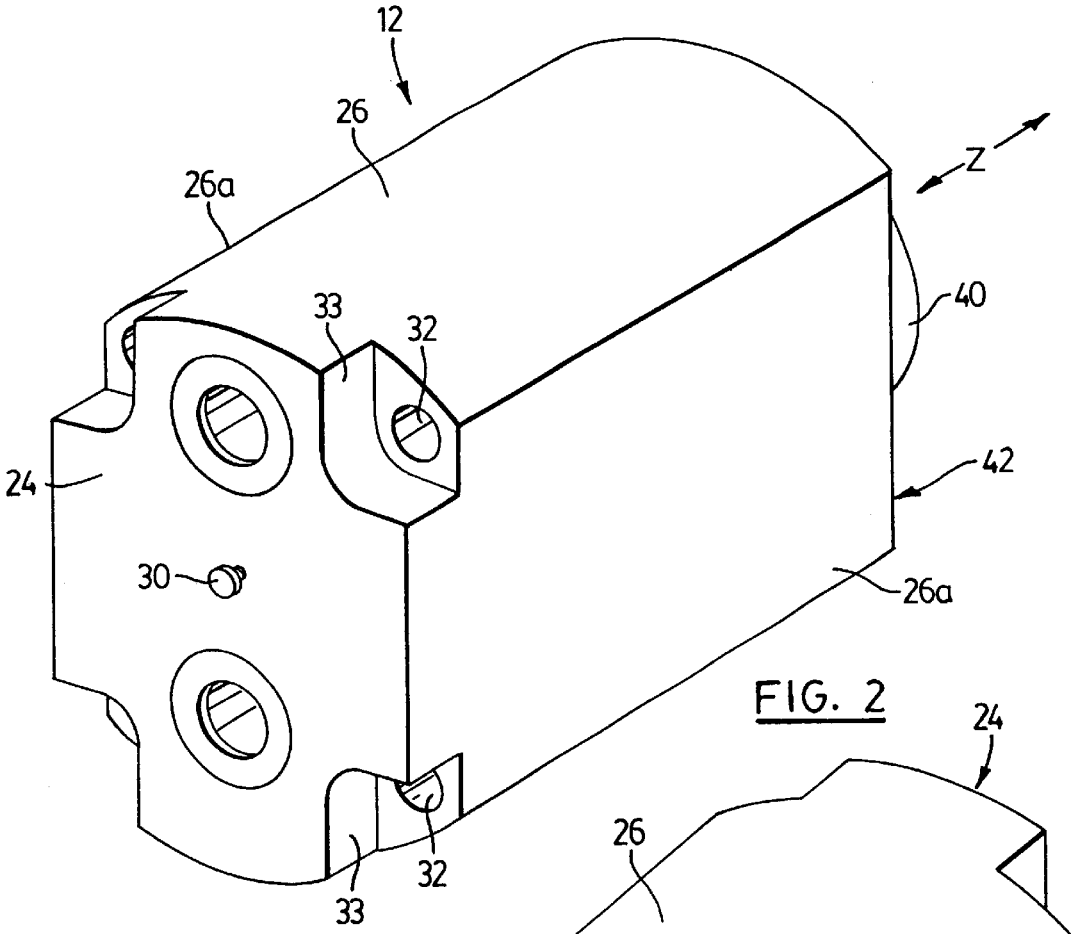
FIG. 2 is a rear perspective view of a piston and cylinder unit of the invention.
Figure 3:
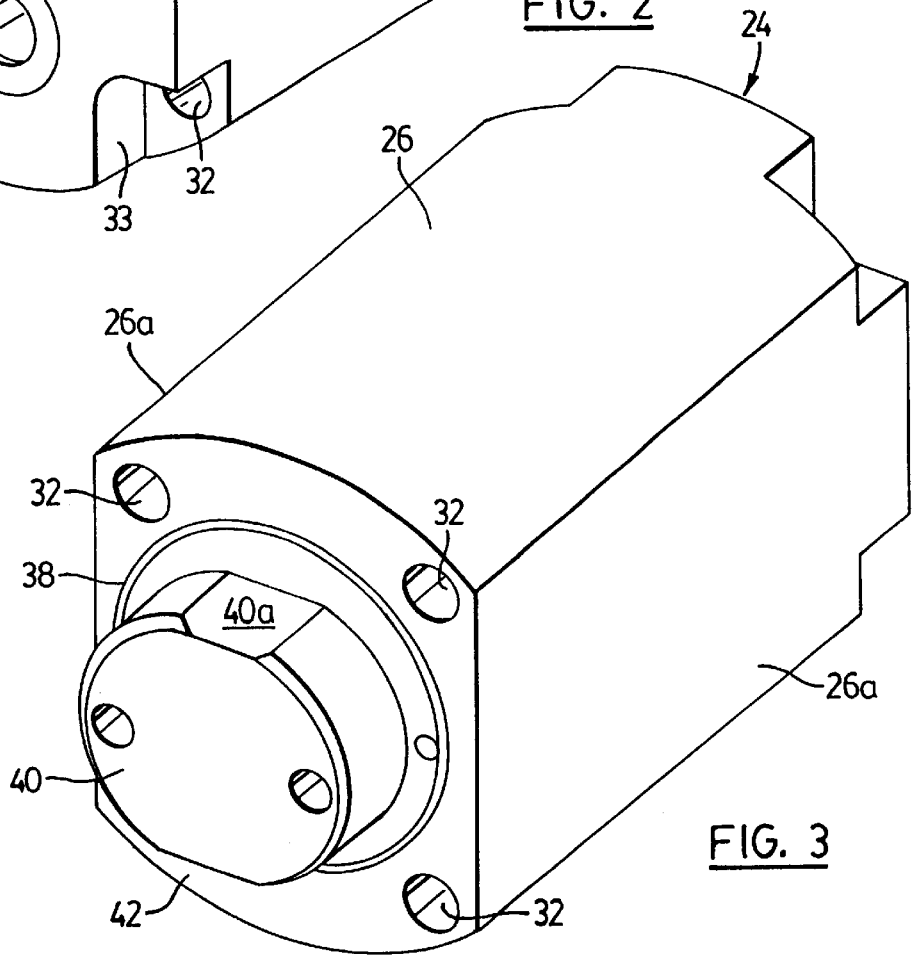
FIG. 3 is a front perspective view of the piston and cylinder unit of FIG. 2.
Figure 4:
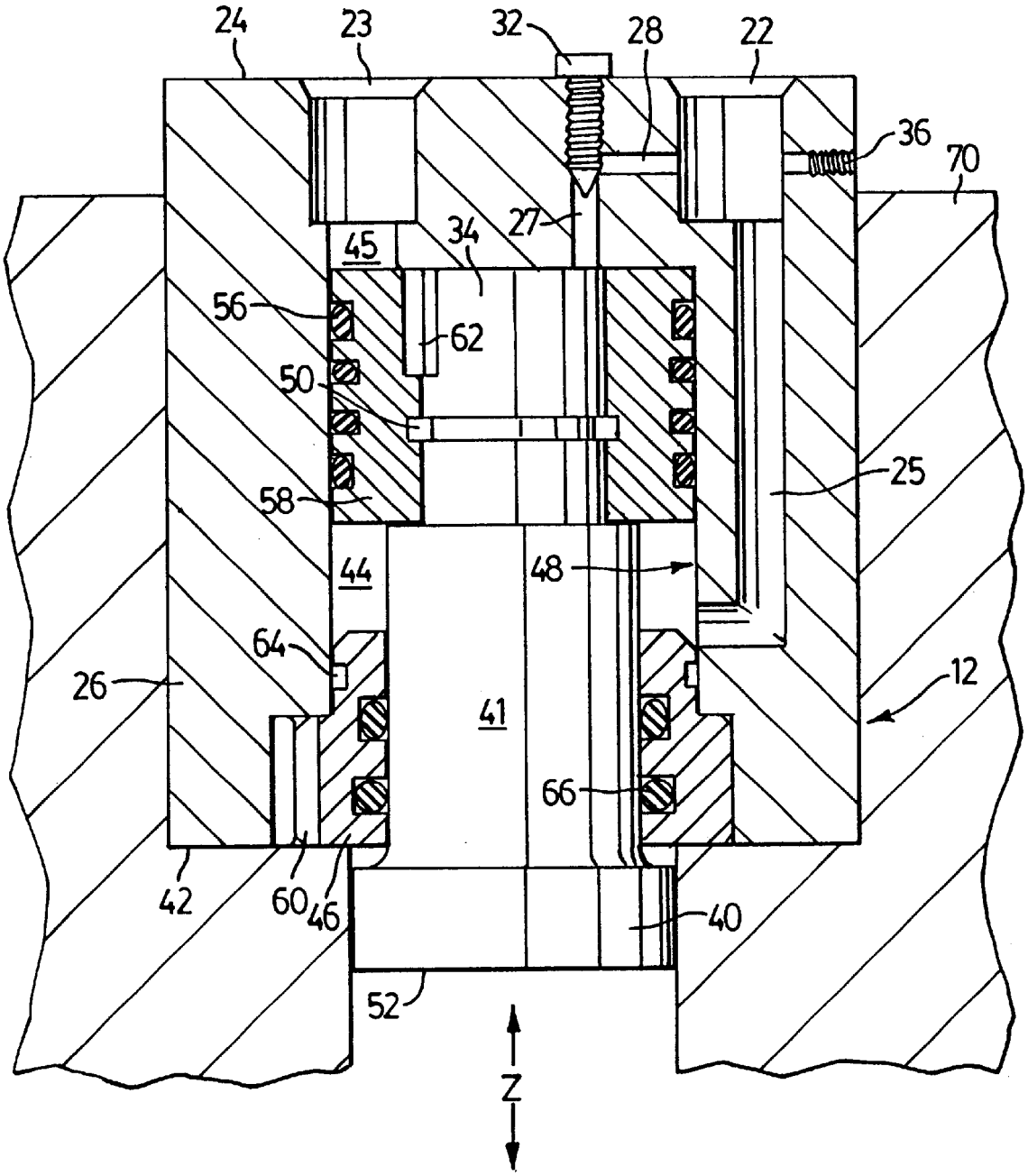
FIG. 4 is cross section view of the piston and cylinder unit of FIG. 2.

FIG. 4 is a cross section view of a piston and cylinder unit 12 according to the present invention. Referring to FIGS. 2, 3 and 4, the piston and cylinder unit of the invention has a cylindrical body 26 with diametrically opposed flat side surfaces 26*a*. Body 26 is preferably constructed from a single piece of steel.

Body 26 contains a rod comprised of three continuous portions, namely rod front 40, rod center 41 and rod base 34. Rod center 41 and rod base 34 are cylindrical. Rod front 40 is cylindrical with diametrically opposed flat surfaces 40*a* (shown in FIG. 3). Rod front 40 may carry a die, punch or other tool on its tool surface 52 for applying force to a workpiece. The rod is preferably constructed from a single piece of hardened steel. As shown in the drawings, the tool surface 52 is preferably a large mounting end.

The piston and cylinder unit is secured to a die block 70. Typically, the die block includes an upper die adapted to be advanced against a lower die to form a workpiece mounted within the die. Preferably, the workpiece is a tube molded in part by hydroforming. The upper or lower die, or both, arc counterbored to receive a piston and cylinder unit 12 of the present invention. Having regard to FIG. 3, a circular section plug 38 is provided on front face 42 around the outside diameter of rod center 41, for sealing bore 48 against the die block.

Piston and cylinder unit 12 is built to receive a punch tool which is advanced along a center line "Z" by rod front 40 to be driven through or against the workpiece as the forming operation between an upper die and a lower die is completed. The piston and cylinder unit 12 is recessed into a counterbore in the die which is aligned with the centerline Z, to pierce or indent the workpiece with the punching tool, or to eject a workpiece, or to perform any other task required.

Piston and cylinder unit 12 is hydraulically operated and a valve manifold may be mounted providing connections to piston extension port 23 and piston retraction port 22 of cylinder unit 12 by suitable lines. A manifold quick connect/disconnect coupling may be provided to connect the piston extension port 23 and piston retraction port 22 to an external hydraulic pressure source. Such quick connect coupling systems allow connections for hydraulic or air pressure lines, and are commercially available, and known in the art (for example, from Cejn Industrial Corporation of Niles, Ill. or Parker Hannifin of Cleveland, Ohio).

The details of the unit 12 may be seen by reference to FIG. 4. A housing cylinder 26 has a rear face 24 and a front face 42. Housing cylinder 26 substantially encloses the rod center 41, rod base 34 and hydraulic actuation components.

Rod base 34 is secured to a seal ring 50 which is located around the circumference of rod base 34. Seal ring 50 is, in turn, secured in locked relation to piston 58. Rod base 34 may be further locked in relation to piston 58 by means of rod and piston key 62. Thus, the rod is secured to piston 58. It will be appreciated that, in other embodiments the rod base 34 and piston 58 may be secured to each other by welds, by a male-female threaded screw fit, or by any other suitable means known in the art. Also, as seen in FIG. 4, piston 58 has an interference fit in relation to rod center 41. It will also be appreciated that in an alternate embodiment, piston 58, rod center 41 and rod base 34 can be one continuous piece.

Thus when piston 58 moves, it carries rod base 34 and its corresponding rod portions 41 and 40 along axis "Z". Between the outer circumference of piston 58 and the inner bore 48, piston seal 56 is provided by O-rings which are slidable in relation to inner bore 48. While piston seals 56 are shown and described herein as being provided by an O-ring, it will be appreciated that any suitable sealing system known in the art can be used for piston seal 56.

Piston extension chamber 45 is the space between piston 58 and piston extension port 23. Piston retraction chamber 44 is the space between front fitting 46 and piston 58 and is in flow communication with piston retraction conduit 25. Piston seal 56 and seal ring 50 combine to render the piston extension chamber 45 and piston retraction chamber 44 fluid-tight against the pressure developed therein. Thus piston 58 may move with the rod along axis "Z", while maintaining a fluid-tight seal in relation to piston extension chamber 45 and piston retraction chamber 44.

A front fitting 46 is secured within bore 48 near the front face 42 of the housing cylinder 26. Front fitting 46 is secured in relation to cylinder 26 by front fitting key 60, which may be welded to cylinder 26 and to front fitting 46. Alternatively, front fitting 46 may be secured to cylinder 26 by any means known in the art, for example, by threading front fitting 46 into the inner bore 48 of cylinder 26.

Front fitting 46 has a front rod seal 66, which comprises an O-ring or other suitable seal known in the art. Front rod seals 66 provide a seal while allowing sliding along axis Z, between the inner bore of front fitting 46 and the outer diameter of rod center 41, which has a circular cross-section. Front fitting 46 is static in relation to inner bore 48 and the retraction chamber 44 is thus sealed with a combination interference fit between the cylinder inner bore 48 and front fitting 46, front fitting key 60, and O-rings 66 or other means known in the art. Thus front fitting 46 acts as an interface seal between rod center 41 and cylinder 26, and creates a seal for the front of piston retraction chamber 44.

An extension chamber bleed passage 27 is provided via a bore through the cylinder from bleeder screw 30 inserted into the rear face 24 to piston extension chamber 45 which is in the bore housing the rod and piston 58, and can be used to establish a slight purging flow through the system to eliminate the need for system bleeding to eliminate air bubbles or to release excess pressure therein. Similarly, a retraction bleed passage 28 is provided as a bore perpendicular through unit 12 which connects retraction conduit 25 to bleeder screw 30 for the purpose of establishing a purging flow through the retraction system. After retraction bleed passage 28 is bored, it is sealed at the end opposite bleeder screw 30 by means of bleeder seal 36.

The pressure required to release fluid or gas through bleed passage 28, and consequently the actual fluid or gas release through the bleeder system can be controlled by adjustment of bleeder screw 30. While in the preferred embodiment described, the bleed pressure is controlled by means of a bleeder screw, it will be understood that other means of controlled pressure release which are known in the art, such as a pressure valve, could be used.

FIG. 2 shows a rear perspective view of a body of a pressure activated piston and cylinder unit 12 of the present invention. Piston retraction port 22, piston extension port 23, bleeder screw 30 and bolt receptacles 32 are all located on rear face 24 of cylinder 26. Thus, all elements that need to be accessed to service or replace the unit are located on rear face 24. Consequently, for service, assembly and disassembly, less clearance is required between the unit and the die. Piston extension port 23, piston retraction port 22, bleeder screw 30 and bolt receptacles 32 are all located on the rear face 24 of the unit such that the conduits are parallel to the axis of retraction "Z". Having regard to FIG. 4, the rear-facing location of piston retraction port 22 is made possible, in part, by the placement of retraction passageway 25 within the body of cylinder 26 and parallel to the axis of retraction "Z". Passageway 25 is bored through the cylinder 26 along axis Z.

Also to facilitate case of assembly and disassembly for accessing and repairing the punch, bolt receptacles 32 are located on the unit such that the bolt heads are located at the rear face of the unit, for easier access. The whole unit can be installed snugly in a narrow recess in the die. While in the preferred embodiment described, the unit is secured to the die by means of bolts, it will be understood that other means of fastening which are known in the art could be used. To further facilitate access, the bolt receptacles 32 are recessed into bolt recesses 33, so that, when in place, the bolt heads (not shown) do not interfere with operations on rear face 24.

In use, the piston 58 executes forward and return strokes as it reciprocates in the cylinder 26 toward and away from the work piece. First and second opposed areas define within the cylinder bore a piston extension chamber 45 and a piston retraction chamber 44. A pump system (not shown) supplies, in an alternating fashion, fluid or gas in the manner set out below. The alternating supply may be electrohydraulically actuated in response to control signals, as from an external controller or from a sensor which is responsive to the position or displacement of the piston 58.

A first pressure is actuated when increased force is necessary, as, for example, when penetrating the work piece during a punching operation. The first pressure is supplied through the piston extension port 23, and to the piston extension chamber 45. Due to the increased pressure on piston 58 and the locked fit between piston 58 and rod base 34, the rod is forced outwards from cylinder 26. Electrohydraulic controls may also switch pressure to the piston retraction chamber, although the piston retraction chamber may be maintained continuously at supply pressure. In either case, subsequent to the punch stroke, controls reduce pressure to the piston extension chamber 45, and the difference in the pressure as between the piston extension chamber 45 and the piston retraction chamber 44 provides a net return force on the piston to effect the return stroke of the piston and rod. The pump system is switched to return pressure after the work is penetrated, depressed or imprinted, as is required for the given task at hand.

In contrast to the known prior art, the present unit may be fitted into a cylindrical pocket bored in a die, and is constructed from and is composed of a one piece body. The whole unit can thus be installed snugly in a narrow recess in the die. Furthermore, by the one-piece body design, construction of the unit is simplified. Another surprising benefit of having a one-piece body is that the entire unit may be made smaller and shorter than the corresponding units of the prior art, in part because the one-piece construction provides enhanced structural integrity of the cylinder 26, as compared to the prior art. Another aspect of this invention is the location of the bleed passage and bleeder screw. In the prior art, the bleed passage and bleeder screw generally are accessed from the side of the cylinder (see the U.S. patent to Lansky, discussed above). Sometimes this required that a bleed passage be extended through the die, and this, of course, requires precision drilling the actual die.

In contrast, in the present invention as shown in FIG. 4, bleed passage 28 communicates directly with retraction passage 25. Bleed passage 28 remains perpendicular to axis "Z", while bleeder screw 30 is located parallel to axis "Z" and the head of the bleeder screw 30 projects from the rear face 24 of cylinder 26. Thus bleeder screw 30 is easy to access, and can be accessed when the unit is placed in a tight confine within a die structure. This positioning also allows for assembly of bleeder screw 30 without precision boring the die to create bleeder passage and bleeder screw apertures, as is required in the prior art.

Thus, the present invention provides a piston and cylinder unit with bolts for attaching the cylinder located only on the rear face of the cylinder and a bleeder screw located on the rear face of the cylinder. This design allows for the unit to be placed into a tight confine within a die structure, which would not be able to receive a piston and cylinder unit of the prior art. Having a cylinder that can be placed in a tight confine thus permits one to construct/assemble the die and the unit to allow for closer punch unit spacing, thus increasing the flexibility one has over the number and relative location of holes to be punched into the work piece. Similarly, the invention allows the unit to be positioned on the die to allow holes to be punched closer to the split line of the work piece than is possible with the prior art. Enabling closer proximity of cylinder units also permits one to use the units of the present invention in a series of sequentially energized cylinders.

The compact size of the piston and cylinder units also decreases the die machining required to install the units, thus increasing the strength of the machined die, and reducing the total cost of the cylinder unit and the cylinder unit installation.

Using bolts to affix the unit to the die block on the rear face of the unit only and ports located on the rear face of the unit only also allow one to make the circular section plug 38 smaller then those available in the prior art. This, in turn, reduces the machining effort required to establish a tight fit between the die and the unit, facilitates maintenance, removal and replacement, and allows positioning of the unit closer to other parts in the die, and in particular in relation to difficult to reach areas of the die and surrounding structures. Thus the invention provides apparatus for quick change of multiple die set tooling on double-acting presses, and provides for a more secure attachment of the unit to the die, as compared to the prior art. Also, in constructing the footprint or circular section plug 38 of FIG. 3 as circular, the total area of footprint that must be sealed between the die and the unit is reduced as compared to other shapes, and thus an improved fit is easier to obtain.

Furthermore, having (a) a one piece construction; (b) a bleeder screw on the rear face of the piston and cylinder unit; and (c) a piston of hardened steel which also serves as an element to support punches, contribute the advantage of being able to reduce the length of the cylinder body 26 as compared to commercially available units. This allows one to make the body of the piston and cylinder unit shorter, which facilitates handling and maintenance.

Another benefit of the present invention may be demonstrated by contrasting the unit of the present invention with the prior art of FIG. 1. As shown in FIG. 1, punch backup 16 is inserted between the piston 18 and the punch piece 15. Punch backup 16 is a hardened steel piece which assists the piston 18 in bracing against the impact transmitted through punch piece 15 in the course of punching holes. Punch backup 16 is necessary to resist against the tendency of a punch to indent rather than punch a hole in a workpiece made of softer metal.

Because the present invention design allows one to build a smaller and shorter unit, rod front 40 may be constructed of hardened, corrosion resistant steel, enabling it to directly support punches when they pierce the workpiece. Thus, a second, special punch backup die part is no longer required; rendering the piston of hardened steel thus allows one to dispense of the use of a special die part between the rod and the punch.

There are various changes and modifications which may be made to the invention as would be apparent to those skilled in the art. These changes or modifications are included in the teachings of this disclosure and it is intended that this invention be limited only by scope of the claims appended hereto.

We claim:

1. A pressure activated piston and cylinder unit for use in a die block comprising:

a body having a rear face and having a front face for communication with said die block;

a piston reciprocal in a bore within said body;

a piston extension chamber in flow communication with a piston extension port and a piston retraction chamber in flow communication with a piston retraction port;

a rod secured to said piston; and a bolt means receptacle for receiving a bolt means for affixing said unit to said die block, said bolt means receptacle extending to the rear face of said unit;

wherein said ports are located on the rear face of said unit.

2. A piston and cylinder unit as claimed in claim 1 wherein said body is one piece.

3. A piston and cylinder unit as claimed in claim 1 wherein said rod is hardened steel.

4. A piston and cylinder unit as claimed in claim 1 wherein said front face is circular.

5. A piston and cylinder unit as claimed in claim 1 further comprising a bleeder passageway in flow communication with said piston retraction chamber, said bleeder passageway extending to the rear face of said unit.

6. A piston and cylinder unit as claimed in claim 1 further comprising a plurality of said bolt means receptacles.

7. A piston and cylinder unit as claimed in claim 1 wherein said bolt means receptacles are recessed into said rear face.

8. A piston and cylinder unit as claimed in claim 1 wherein said piston retraction port is in communication with said piston retraction chamber through a retraction conduit which extends through said piston and cylinder unit parallel to said rod.

9. A piston and cylinder unit as claimed in claim 1 wherein said die block is a hydroforming die block.

10. A piston and cylinder unlit as claimed in claim 5 wherein said bleeder passageway communicates directly with said piston extension chamber.

11. A piston and cylinder unit as claimed in claim 5, wherein said bleeder passageway communicates directly with said piston retraction chamber.

12. A piston and cylinder unit as claimed in claim 1, wherein said unit is cylindrical.

* * * * *

UNITED STATES PATENT AND TRADEMARK OFFICE
Certificate

Patent No. 6,276,258 B1 Patented: August 21, 2001

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: David R. MacMillan, Ilderton, CA; Gary Morphy, Woodstock, CA; and Roland Krause, Kitchener, Ontario, Canada.

Signed and Sealed this Thirteenth Day of May 2003.

EDWARD LOOK
*Supervisory Patent Examiner*
Art Unit 3745